US008418704B1

(12) United States Patent
Teeters

(10) Patent No.: US 8,418,704 B1
(45) Date of Patent: Apr. 16, 2013

(54) POWER ADJUSTABLE CRUTCH ASSEMBLY

(76) Inventor: Richard L. Teeters, Alliance, OH (US)

( * ) Notice: Subject to any disclaimer, the term of this patent is extended or adjusted under 35 U.S.C. 154(b) by 68 days.

(21) Appl. No.: 13/216,323

(22) Filed: Aug. 24, 2011

(51) Int. Cl.
*A61H 3/02* (2006.01)

(52) U.S. Cl.
USPC ..... 135/69; 135/75

(58) Field of Classification Search ..... 135/66, 135/69, 75
See application file for complete search history.

(56) References Cited

U.S. PATENT DOCUMENTS

| | | | | |
|---|---|---|---|---|
| 3,157,189 | A | 11/1964 | Farnham | |
| 3,394,933 | A * | 7/1968 | Benoit | 482/67 |
| 3,416,546 | A | 12/1968 | Carpenter | |
| 4,750,507 | A | 6/1988 | Kazda | |
| 5,112,076 | A * | 5/1992 | Wilson | 280/657 |
| 5,282,486 | A | 2/1994 | Hoover | |
| D361,655 | S | 8/1995 | Lunceford | |
| 7,487,788 | B2 * | 2/2009 | Baker | 135/72 |
| 2004/0206385 | A1 * | 10/2004 | Turlington | 135/67 |
| 2008/0053502 | A1 | 3/2008 | Tseng | |
| 2010/0186789 | A1 * | 7/2010 | Vegvary | 135/69 |
| 2011/0061698 | A1 * | 3/2011 | Iwata | 135/69 |

* cited by examiner

*Primary Examiner* — Noah Chandler Hawk

(57) ABSTRACT

A power adjustable crutch assembly is provided for assisting a user in transitioning between a seated position and a standing position. The assembly includes a support configured for positioning under an arm of a user. An upper frame is coupled to and extends downwardly from the support. A lower frame is slidably coupled to the upper frame. An adjustment assembly is operationally coupled to the lower frame and the upper frame. The upper frame is adjustable to extend a selectable length from the lower frame. A foot configured for frictionally engaging a ground surface is coupled to a bottom of the lower frame.

10 Claims, 6 Drawing Sheets

POWER ADJUSTABLE CRUTCH ASSEMBLY

BACKGROUND OF THE DISCLOSURE

1. Field of the Disclosure

The disclosure relates to crutch devices and more particularly pertains to a new crutch device for assisting a user in transitioning between a seated position and a standing position.

2. Summary of the Disclosure

An embodiment of the disclosure meets the needs presented above by generally comprising a support configured for positioning under an arm of a user. An upper frame is coupled to and extends downwardly from the support. A lower frame is slidably coupled to the upper frame. An adjustment assembly is operationally coupled to the lower frame and the upper frame. The upper frame is adjustable to extend a selectable length from the lower frame. A foot configured for frictionally engaging a ground surface is coupled to a bottom of the lower frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
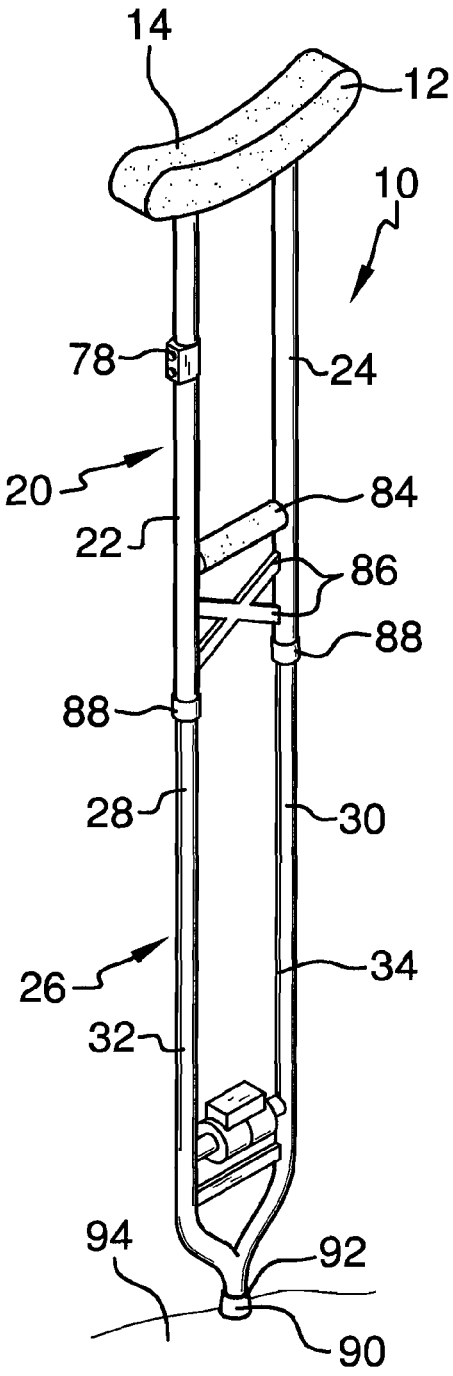
FIG. 1 is a top front side perspective view of a power adjustable crutch assembly according to an embodiment of the disclosure.
Figure 2:
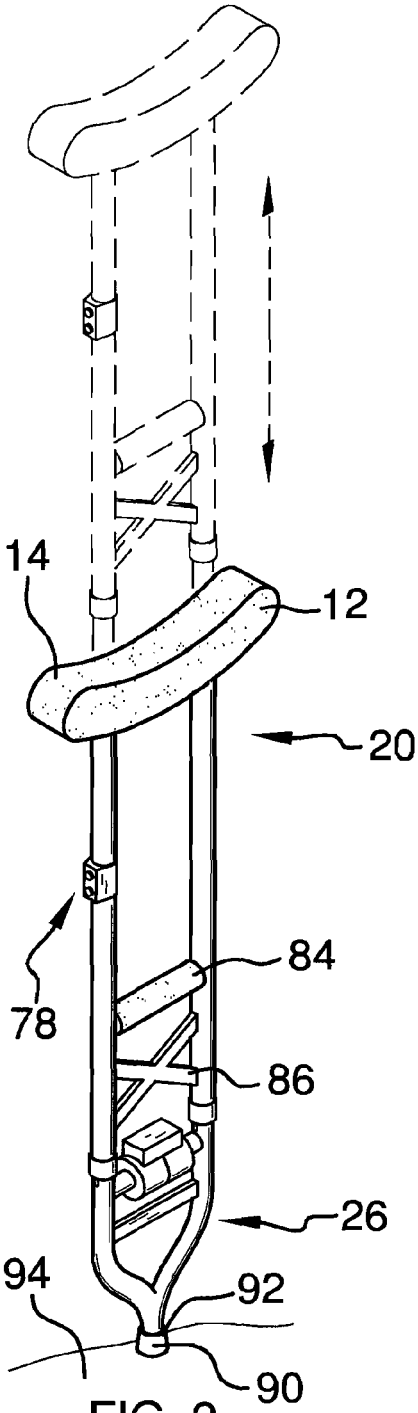
FIG. 2 is a top front side perspective view of an embodiment of the disclosure.
Figure 3:
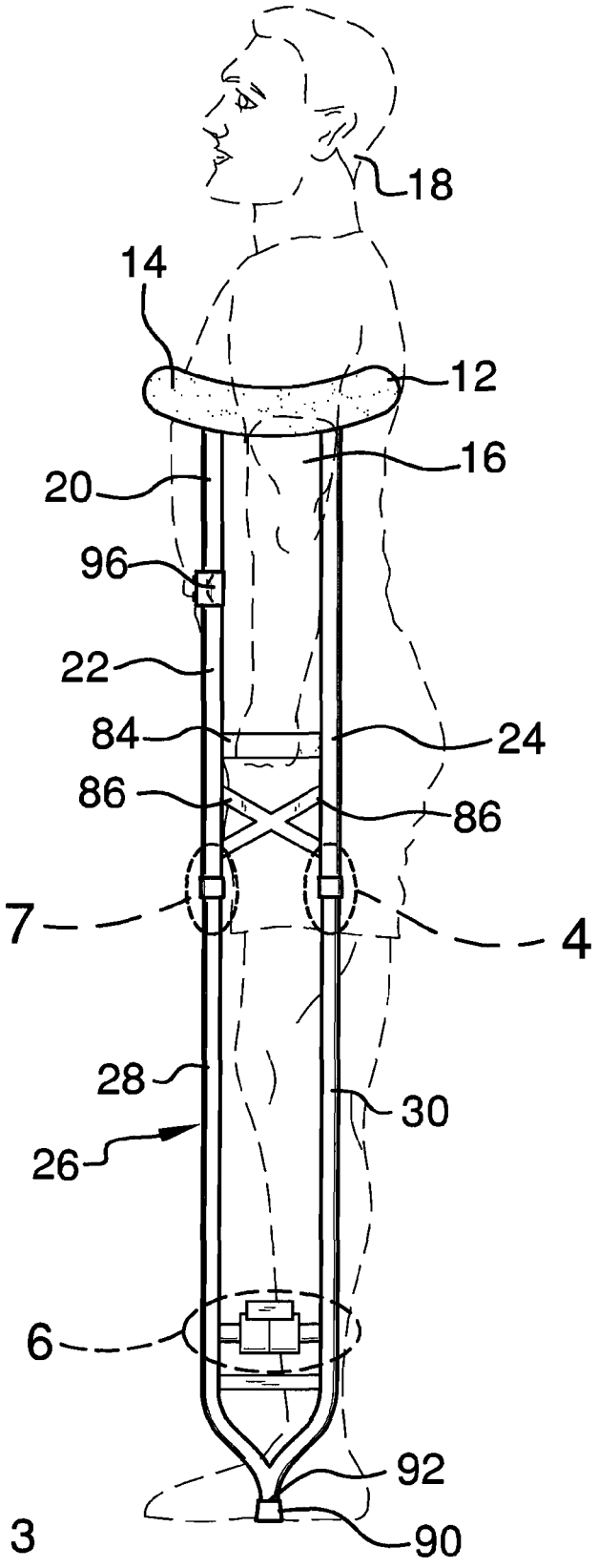
FIG. 3 is a side view of an embodiment of the disclosure.
Figure 4:
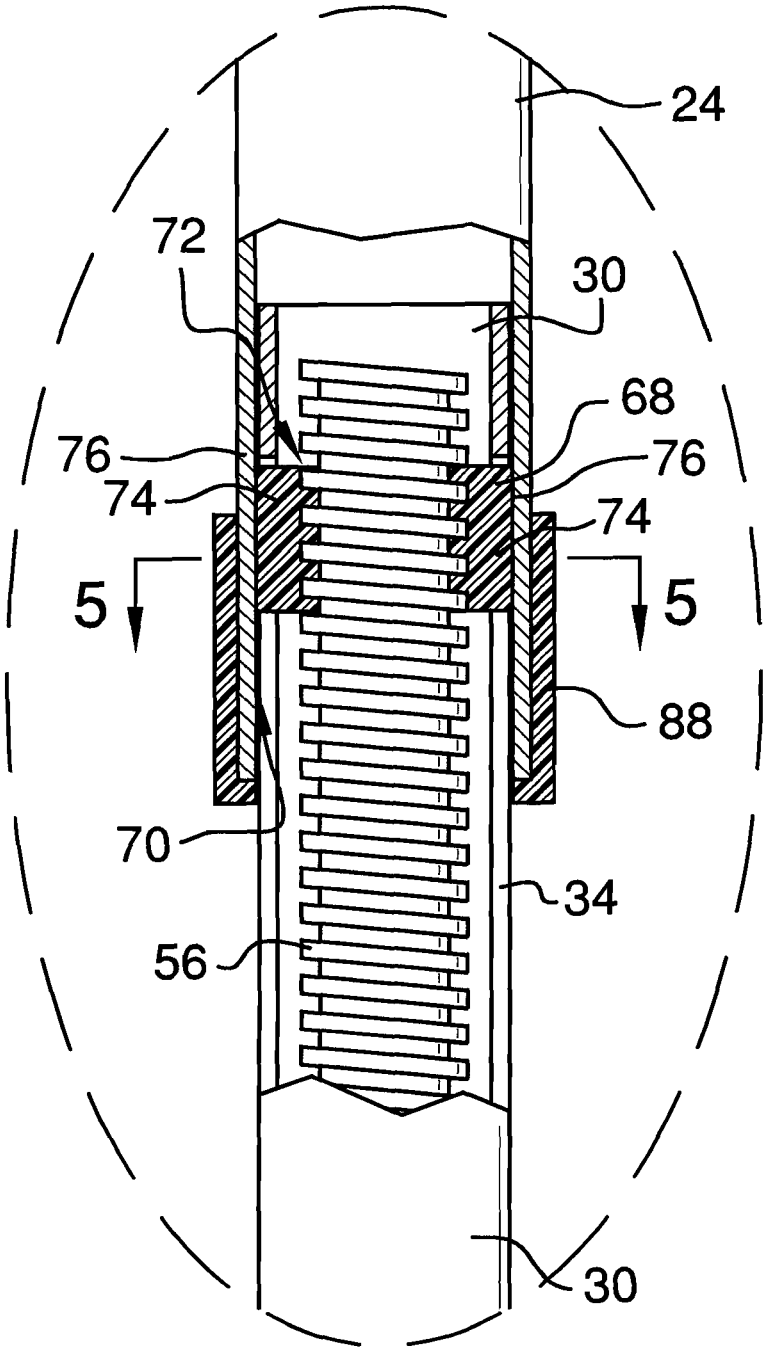
FIG. 4 is a partial cut-away detail view of an embodiment of the disclosure.
Figure 5:
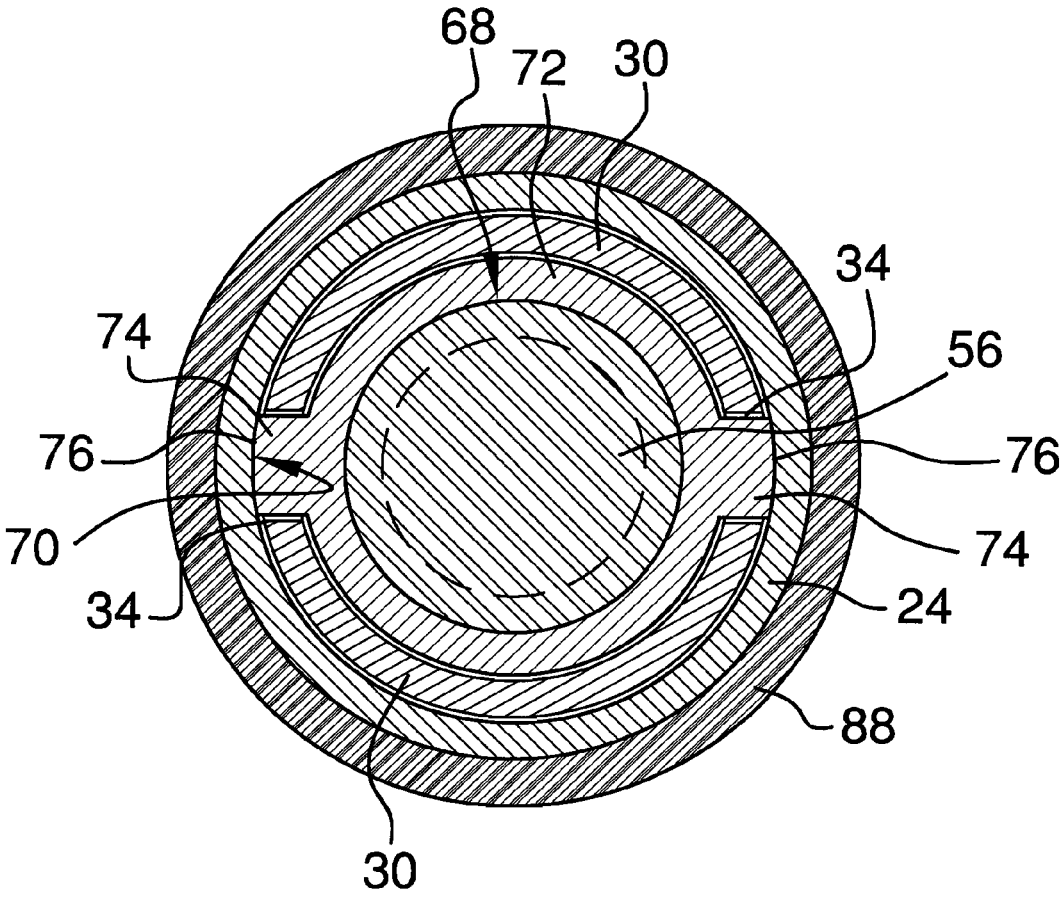
FIG. 5 is a cross-sectional view of an embodiment of the disclosure taken along line 5-5 of FIG. 4.
Figure 6:
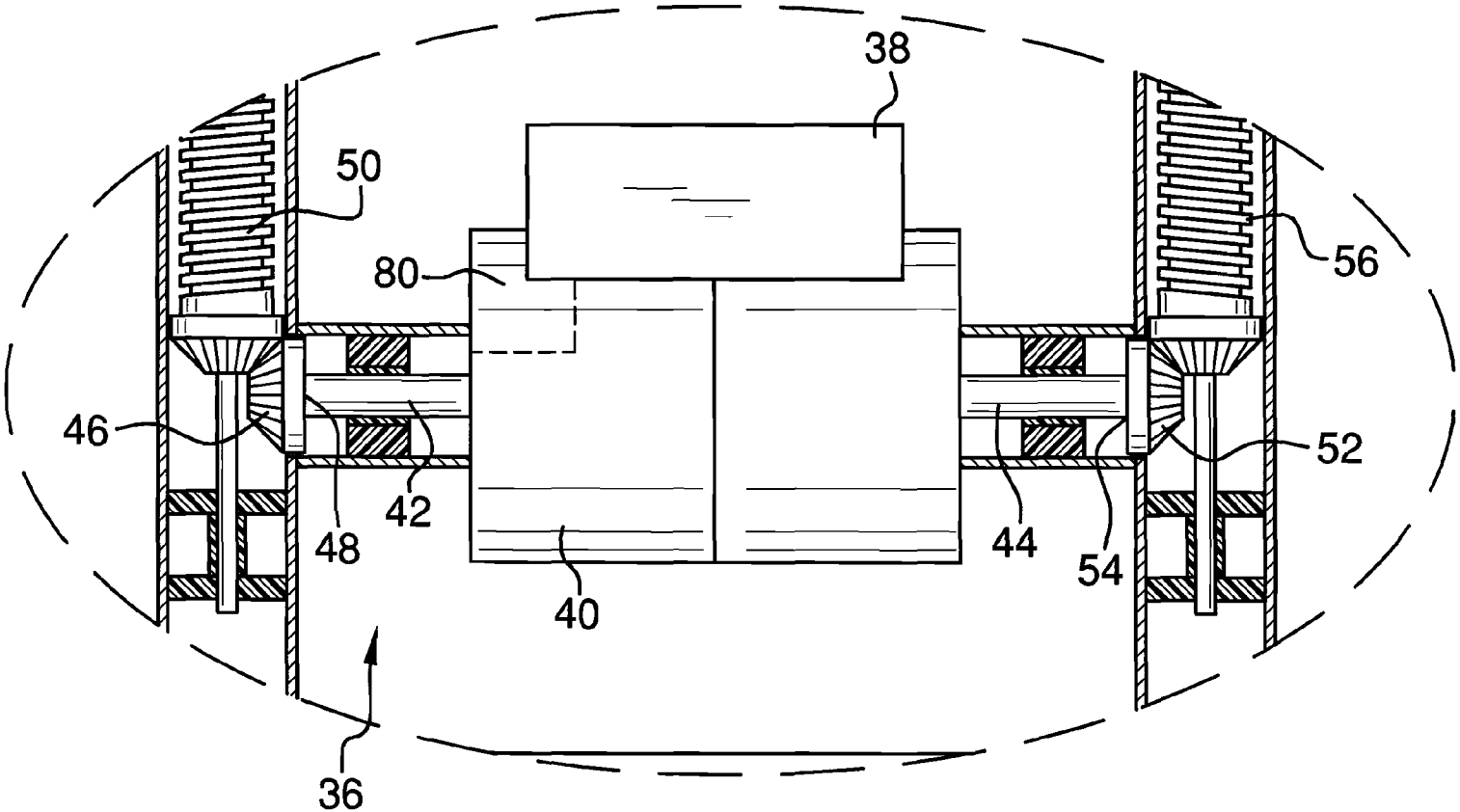
FIG. 6 is a partial cut-away detail view of an embodiment of the disclosure.
Figure 7:
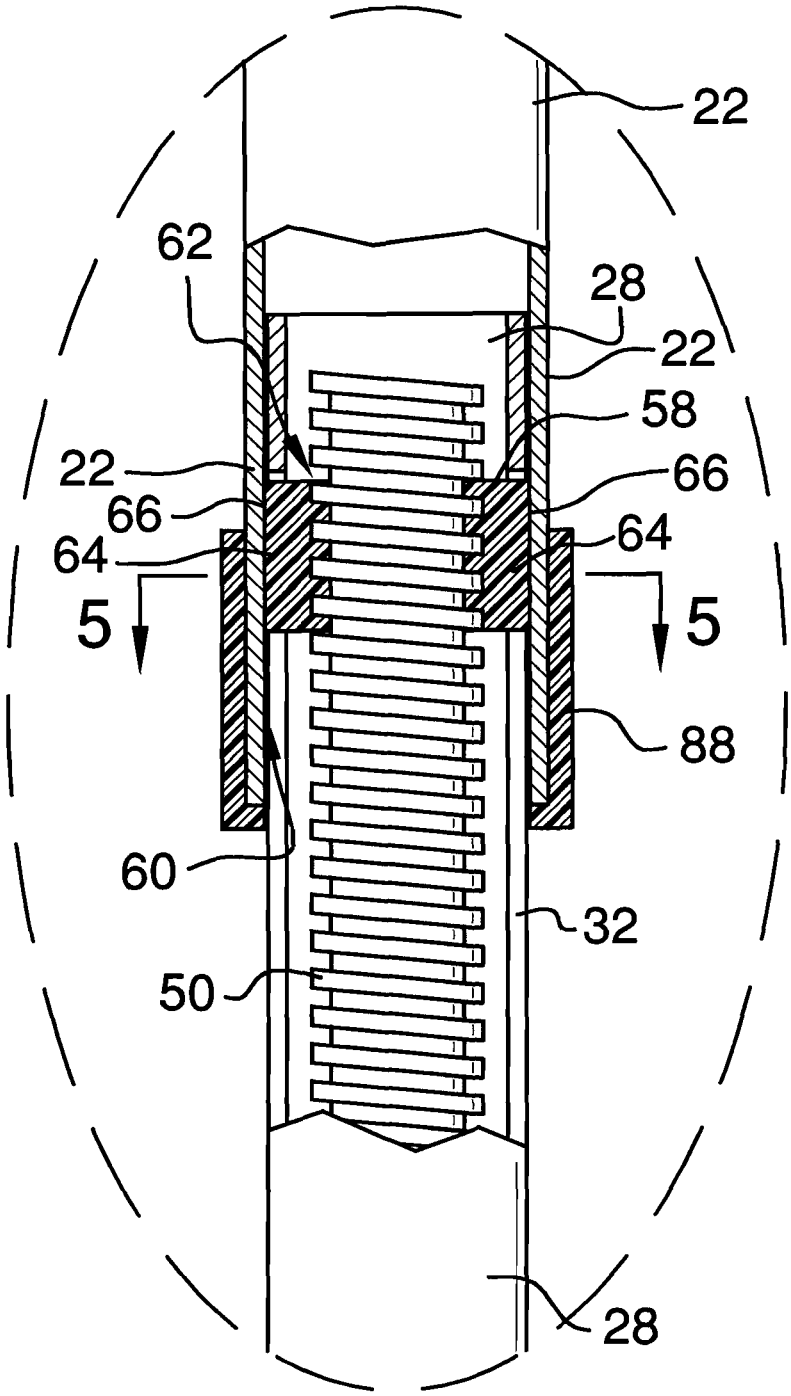
FIG. 7 is a partial cut-away detail view of an embodiment of the disclosure.

With reference now to the drawings, and in particular to FIGS. 1 through 6 thereof, a new crutch device embodying the principles and concepts of an embodiment of the disclosure and generally designated by the reference numeral 10 will be described.

As best illustrated in FIGS. 1 through 6, the power adjustable crutch assembly 10 generally comprises a support 12 having a curved upper surface 14 configured for positioning under an arm 16 of a user 18. An upper frame 20 is coupled to and extends downwardly from the support 12. The upper frame 20 has a first pole 22 and a second pole 24. A lower frame 26 is slidably coupled to the upper frame 20. The lower frame 26 has a pair of spaced posts 28,30. The first post 28 of the lower frame 26 may be slidably received in the first pole 22 of the upper frame 20 and the second post 30 of the lower frame 26 is slidably received in the second pole 24 of the upper frame 20. The first post 28 includes a pair of guide slots 32 extending along a length of the first post 28. The second post 30 includes a pair of guide grooves 34 extending along a length of the second post 30.

An adjustment assembly 36 is operationally coupled to both the lower frame 26 and the upper frame 20 such that the upper frame 20 is adjustable to extend a selectable length from the lower frame 26. The adjustment assembly 36 including a power source 38 and a motor 40 which may be coupled to the lower frame 26. The motor 40 has a first shaft 42 extending towards the first post 28 and a second shaft 44 extending towards the second post 30. The adjustment assembly 36 has a first bevel gear 46 coupled to a distal end 48 of the first shaft 42 relative to the motor 40. The first bevel gear 46 extends into the first post 28. The adjustment assembly 36 includes a first worm gear 50 positioned in the first post 28. The first worm gear 50 is operationally coupled to the first bevel gear 46. The adjustment assembly 36 also has a second bevel gear 52 coupled to a distal end 54 of the second shaft 44 relative to the motor 40. The second bevel gear 52 extends into the second post 30. The adjustment assembly 36 also includes a second worm gear 56 positioned in the second post 30. The second worm gear 56 is operationally coupled to the second bevel gear 52.

A first nut 58 is fixedly coupled to an interior surface 60 of the first pole 22 of the upper frame 20. The first worm gear 50 is inserted through the first nut 58 whereby rotation of the first worm gear 50 in the first nut 58 moves the upper frame 20 relative to the lower frame 26. The first nut 58 has a central portion 62 and a pair of tongues 64 extending outwardly from the central portion 62 of the first nut 58. Each tongue 64 of the first nut 58 is positioned in an associated one of the guide slots 32 of the first post 28. An outer end 66 of each tongue 64 of the first nut 58 is coupled to the interior surface 60 of the first pole 22 of the upper frame 20.

Similarly, a second nut 68 is fixedly coupled to an interior surface 70 of the second pole 24 of the upper frame 20. The second worm gear 56 is inserted through the second nut 68 whereby rotation of the second worm gear 56 in the second nut 68 also moves the upper frame 20 relative to the lower frame 26. The second nut 68 has a central portion 72 and a pair of tongues 74 extending outwardly from the central portion 72 of the second nut 68. Each tongue 74 of the second nut 68 is positioned in an associated one of the guide grooves 34 of the second post 30. An outer end 76 of each tongue 74 of the second nut 68 is coupled to the interior surface 70 of the second pole 24 of the upper frame 20.

A switch 78 may be coupled to the upper frame 20. The switch 78 is operationally coupled to the adjustment assembly 36 whereby manipulation of the switch 78 activates the adjustment assembly 36 to move the upper frame 20 relative to the lower frame 26 to either lengthen or shorten the crutch assembly 10 as desired. The switch 78 may be hardwired to the adjustment assembly 36 or a wireless transmitter 96 may be operationally coupled to the switch 78. The adjustment assembly 36 may include a receiver 80 operationally coupled to the motor 40 for activating the motor 40 when the receiver 80 receives an activation signal sent by the transmitter 96 upon manipulation of the switch 78.

For stability during use, the crutch assembly 10 may include a hand grip 84 extending between the first pole 22 and the second pole 24 of the upper frame 20 so that the hand grip 84 remains in a static position relative to the support 12 during adjustment of the upper frame 20 relative to the lower frame 26. A pair of crossed beams 86 may also be coupled to and extend between the first pole 22 and the second pole 24 of the upper frame 20. A pair of end caps 88 may each be coupled to an associated one of the first pole 28 and the second pole 30. Each end cap 88 has a hole therein for receiving an associated one of the first post 28 and the second post 30. The end caps 88 may each be constructed of a pliable material and abut the first post 28 and second post 30 to inhibit dirt or other matter from contacting and fouling the adjustment assembly through a junction between the upper frame 20 and the lower frame 26. A foot 90 is coupled to a bottom 92 of the lower frame 26 to frictionally engage a ground surface 94.

In use, a seated person may shorten the overall length of the crutch assembly 10 and position the support 12 under the arm 14. The switch 78 is then manipulated to move the upper frame 20 relative to the lower frame 26 lengthening the crutch assembly 10 and providing an upward force on the user 16 to facilitate rising from the seated position. The switch 78 may also be manipulated to shorten the length of the crutch assembly 10 to provide support to the user 16 as the user is lowered into the seated position from a standing position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A power adjustable crutch assembly comprising:

a support, said support being configured for positioning under an arm of a user;

an upper frame coupled to and extending downwardly from said support;

a lower frame slidably coupled to said upper frame;

an adjustment assembly operationally coupled to said lower frame and said upper frame whereby said upper frame is adjustable to extend a selectable length from said lower frame; and a foot coupled to a bottom of said lower frame, said foot being configured for frictionally engaging a ground surface;

said lower frame having a pair of spaced posts;

said adjustment assembly including a motor coupled to said lower frame, said motor having a first shaft extending towards a first one of said posts;

said adjustment assembly having a first bevel gear coupled to an distal end of said first shaft relative to said motor, said first bevel gear extending into said first one of said posts, said adjustment assembly including a first worm gear positioned in said first one of said posts, said first worm gear being operationally coupled to said first bevel gear; and a first nut fixedly coupled to said upper frame, said first worm gear being inserted through said first nut whereby rotation of said first worm gear in said first nut moves said upper frame relative to said lower frame;

said motor having a second shaft extending towards a second one of said posts;

said adjustment assembly having a second bevel gear coupled to a distal end of said second shaft relative to said motor, said second bevel gear extending into said second one of said posts, said adjustment assembly including a second worm gear positioned in said second one of said posts, said second worm gear being operationally coupled to said second bevel gear; and a second nut fixedly coupled to said upper frame, said second worm gear being inserted through said second nut whereby rotation of said second worm gear in said second nut moves said upper frame relative to said lower frame;

said second one of said posts having a pair of guide grooves extending along a length of said second post; and said second nut having a central portion and a pair of tongues extending outwardly from said central portion of said second nut, each said tongue of said second nut being positioned in an associated one of said guide grooves of said second post.

2. The assembly of claim 1, further including a switch coupled to said upper frame, said switch being operationally coupled to said adjustment assembly whereby manipulation of said switch activates said adjustment assembly to move said upper frame relative to said lower frame.

3. The assembly of claim 2, further comprising:

said adjustment assembly including a power source;

said adjustment assembly further including a receiver, said receiver being operationally coupled to said motor for activating said motor when said receiver receives an activation signal; and a transmitter operationally coupled to said switch, said transmitter sending said activation signal upon manipulation of said switch.

4. The assembly of claim 1, further including an outer end of each said tongue of said second nut being coupled to an interior surface of a second pole of said upper frame, said second post of said lower frame being slidably received in said second pole of said upper frame.

5. The assembly of claim 4, further including a hand grip extending between said first pole and said second pole of said upper frame.

6. The assembly of claim 4, further including a pair of crossed beams coupled to and extending between said first pole and said second pole of said upper frame.

7. The assembly of claim 4, further including a pair of end caps, each said end cap being coupled to an associated one of said first pole and said second pole, each end cap having a hole therein receiving an associated one of said first post and said second post.

8. A power adjustable crutch assembly comprising:

a support, said support being configured for positioning under an arm of a user;

an upper frame coupled to and extending downwardly from said support;

a lower frame slidably coupled to said upper frame;

an adjustment assembly operationally coupled to said lower frame and said upper frame whereby said upper frame is adjustable to extend a selectable length from said lower frame;

a foot coupled to a bottom of said lower frame, said foot being configured for frictionally engaging a ground surface;

said lower frame having a pair of spaced posts;

said adjustment assembly including a motor coupled to said lower frame, said motor having a first shaft extending towards a first one of said posts;

said adjustment assembly having a first bevel gear coupled to an distal end of said first shaft relative to said motor, said first bevel gear extending into said first one of said posts, said adjustment assembly including a first worm gear positioned in said first one of said posts, said first worm gear being operationally coupled to said first bevel gear;

a first nut fixedly coupled to said upper frame, said first worm gear being inserted through said first nut whereby rotation of said first worm gear in said first nut moves said upper frame relative to said lower frame;

said first one of said posts having a pair of guide slots extending along a length of said first post; and said first nut having a central portion and a pair of tongues extending outwardly from said central portion of said first nut, each said tongue of said first nut being positioned in an associated one of said guide slots of said first post.

9. The assembly of claim 8, further including an outer end of each said tongue of said first nut being coupled to an interior surface of a first pole of said upper frame, said first post of said lower frame being slidably received in said first pole of said upper frame.

10. A power adjustable crutch assembly comprising:

a support, said support being configured for positioning under an arm of a user;

an upper frame coupled to and extending downwardly from said support, said upper frame having a first pole and a second pole;

a lower frame slidably coupled to said upper frame, said lower frame having a pair of spaced posts, a first one of said posts having a pair of guide slots extending along a length of said first one of said posts, a second one of said posts having a pair of guide grooves extending along a length of said second one of said posts;

an adjustment assembly operationally coupled to said lower frame and said upper frame whereby said upper frame is adjustable to extend a selectable length from said lower frame, said adjustment assembly including a power source, said adjustment assembly including a motor coupled to said lower frame, said motor having a first shaft extending towards a first one of said posts and a second shaft extending towards a second one of said posts, said adjustment assembly including a receiver, said receiver being operationally coupled to said motor for activating said motor when said receiver receives an activation signal, said adjustment assembly having a first bevel gear coupled to a distal end of said first shaft relative to said motor, said first bevel gear extending into said first one of said posts, said adjustment assembly including a first worm gear positioned in said first one of said posts, said first worm gear being operationally coupled to said first bevel gear, said adjustment assembly having a second bevel gear coupled to a distal end of said second shaft relative to said motor, said second bevel gear extending into said second one of said posts, said adjustment assembly including a second worm gear positioned in said second one of said posts, said second worm gear being operationally coupled to said second bevel gear;

a first nut fixedly coupled to said upper frame, said first worm gear being inserted through said first nut whereby rotation of said first worm gear in said first nut moves said upper frame relative to said lower frame, said first nut having a central portion and a pair of tongues extending outwardly from said central portion of said first nut, each said tongue of said first nut being positioned in an associated one of said guide slots of said first post, an outer end of each said tongue of said first nut being coupled to an interior surface of said first pole of said upper frame, said first post of said lower frame being slidably received in said first pole of said upper frame;

a second nut fixedly coupled to said upper frame, said second worm gear being inserted through said second nut whereby rotation of said second worm gear in said second nut moves said upper frame relative to said lower frame, said second nut having a central portion and a pair of tongues extending outwardly from said central portion of said second nut, each said tongue of said second nut being positioned in an associated one of said guide grooves of said second post, an outer end of each said tongue of said second nut being coupled to an interior surface of said second pole of said upper frame, said second post of said lower frame being slidably received in said second pole of said upper frame;

a switch coupled to said upper frame, said switch being operationally coupled to said adjustment assembly whereby manipulation of said switch activates said adjustment assembly to move said upper frame relative to said lower frame;

a transmitter operationally coupled to said switch, said transmitter sending said activation signal upon manipulation of said switch;

a hand grip extending between said first pole and said second pole of said upper frame;

a pair of crossed beams coupled to and extending between said first pole and said second pole of said upper frame;

a pair of end caps, each said end cap being coupled to an associated one of said first pole and said second pole, each end cap having a hole therein receiving an associated one of said first post and said second post; and a foot coupled to a bottom of said lower frame, said foot being configured for frictionally engaging a ground surface.

* * * * *